US005511452A

United States Patent [19]

Edmonds

[11] Patent Number: 5,511,452

[45] Date of Patent: Apr. 30, 1996

[54] RATCHET SPEED HANDLE

[76] Inventor: Douglas R. Edmonds, 926 Silver Leaf Pl., Loveland, Colo. 80538

[21] Appl. No.: 326,863

[22] Filed: Oct. 21, 1994

[51] Int. Cl.[6] ..... B25B 13/46; B25G 1/00

[52] U.S. Cl. ..... 81/73; 81/29; 81/32; 81/35

[58] Field of Search ..... 81/73, 28–37

[56] References Cited

U.S. PATENT DOCUMENTS

| | | | |
|---|---|---|---|
| 754,069 | 3/1904 | Johnson | 81/73 X |
| 754,295 | 3/1904 | Foit | 81/35 |
| 1,326,022 | 12/1919 | Callaway | 81/73 |
| 1,409,510 | 3/1922 | Adams | 81/73 |
| 1,714,361 | 5/1929 | Gougler | 81/35 |
| 1,810,006 | 6/1931 | Edwards | 81/35 X |
| 3,343,434 | 9/1967 | Schroeder | 81/29 X |

*Primary Examiner*—D. S. Meislin

[57] ABSTRACT

A speed handle which includes a ratchet drive on the working end. A conventional socket can be attached to the mounting end of the ratchet drive. The speed handle is especially useful in areas where there is very little room for operating a conventional wrench or conventional ratchet wrench.

1 Claim, 1 Drawing Sheet

RATCHET SPEED HANDLE

FIELD OF THE INVENTION

This invention relates to hand tools. More particularly, this invention relates to ratchet tools.

BACKGROUND OF THE INVENTION

Speed handles have previously been used for ease of rotation of a socket being used to loosen or tighten bolts or nuts. There are many situations where the use of such a speed handle is advantageous. However, there are also situations where use of a speed handle is extremely inconvenient or very cumbersome.

Ratchet drives have also been previously used to drive socket wrenches. The ratchet includes an elongated straight handle.

There are various situations in which a conventional ratchet wrench is cumbersome or impossible to use, e.g., in tight places where there is little room for the ratchet handle. Use of a conventional ratchet wrench in such situations often leads to skinned or bruised knuckles.

There has not heretofore been provided a tool having the advantages and features provided by the present invention.

SUMMARY OF THE INVENTION

In accordance with the present invention there is provided an improved speed handle which includes a ratchet drive on the working end. A conventional socket can be attached to the mounting end of the ratchet drive.

The improved speed handle is extremely useful for tightening or loosening nuts and bolts, especially in areas where there is very little roof for operating a conventional wrench or conventional ratchet wrench. The inclusion of a ratchet drive in a speed handle greatly and significantly enhances the utility and functionality of the speed handle.

The improved speed handle can be used as a conventional speed handle when there is sufficient room to permit 360° rotation. Yet, in areas where it is not possible to freely rotate the speed handle, the presence of the ratchet drive enables the speed handle to operate in the desired manner to tighten or loosen screws, nuts, or bolts as required. This is especially convenient in tight working areas such as in corners or in other areas where use of a conventional wrench or ratchet is not possible or is inconvenient. Thus, the tool of this invention can be used as a conventional speed handle or conventional ratchet wrench in addition to being used as a combination wrench where necessary or desired.

Other advantages of the improved speed handle of the invention will be apparent from the following detailed description and the accompanying drawing.

BRIEF DESCRIPTION OF THE DRAWING

The invention is described in more detail hereinafter with reference to the accompanying drawing in which.

DETAILED DESCRIPTION OF THE INVENTION

Figure 1:
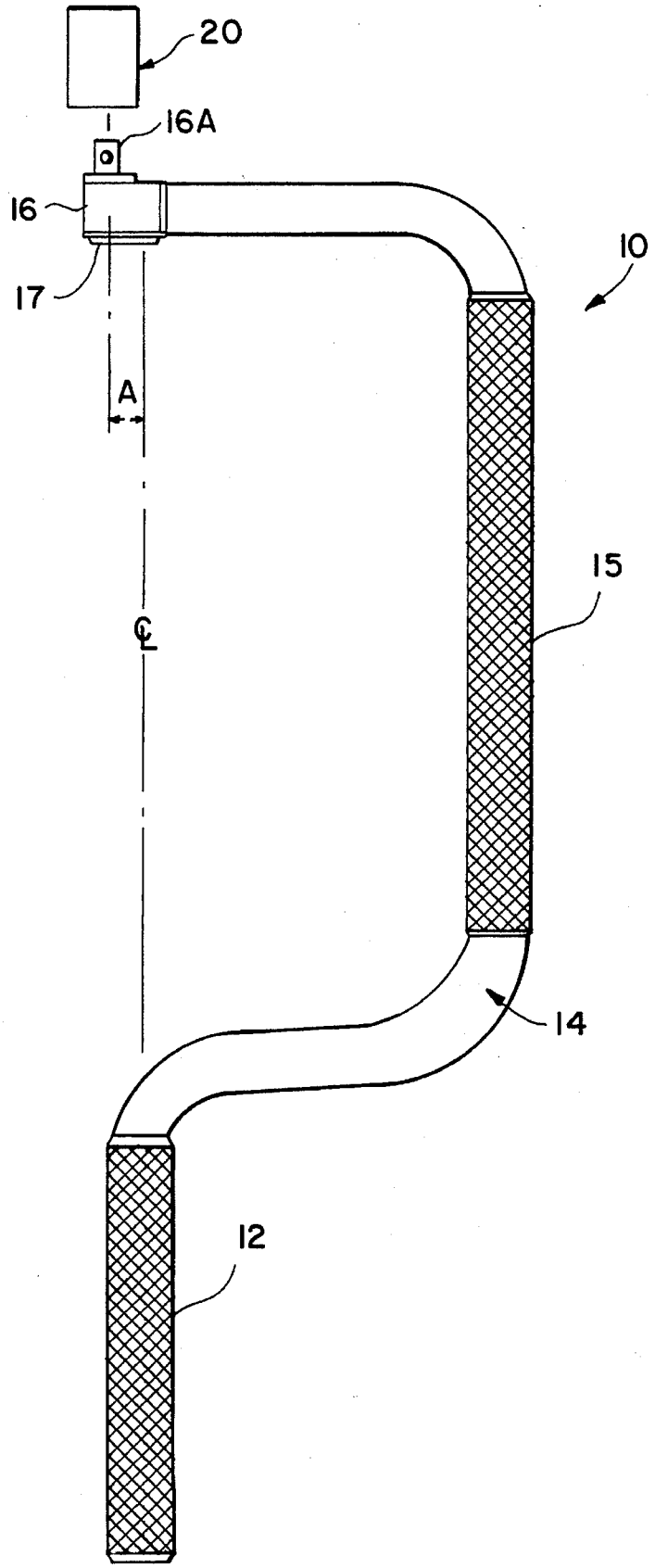
FIG. 1 is a plan view of the improved speed handle of the invention.

In the drawing there is shown one embodiment of improved speed handle 10 of the invention which includes a U-shaped handle 14 having a main grip portion 12 and an offset handle portion 15. A conventional ratchet drive mechanism 16 with socket mounting stud 16A is secured to the operating end of the speed handle, as shown. A conventional socket 20 can be detachably connected to the ratchet stud.

In operation, a desired Socket 20 is attached to the mounting stud 16A of ratchet drive 16. Then the socket can be slipped onto the screw, nut or bolt to be loosened or tightened, after which rotational force is applied to the socket by means of angular or rotational movement of handle portion 15 relative to grip portion 12. The ratchet 16 includes a lever 17 which is movable between first and second positions. When the lever is in its first position the socket can be rotatably driven in a first direction, and when the lever is in its second position the socket can be rotatably driven in the opposite direction by handle 15. Significant leverage can be applied to the socket by angular movement of handle portion 15.

Preferably the mounting stud 16A is slightly offset from and parallel to the longitudinal centerline C.L. of the speed handle. The amount of offset A may vary (e.g., from 0.25 to 0.5 inch), but a distance of about ⅜ inch is preferred. This offset enables the speed handle to be used even in areas where there is very limited room available.

Other variants are possible without departing from the scope of this invention. For example, the length of the speed handle may vary. Also, the size of the mounting stud 16A may vary so as to receive different types of sockets (e.g., ¼ inch, ⅜ inch, or ½ inch drive). Handle portions 12 and 15 may also include tubular grip sleeves which freely rotate relative to the handle portions.

What is claimed is:

1. A speed handle tool having a working end, an opposite end having a grip portion, and single offset crank handle, wherein said tool further comprises a ratchet drive secured to said working end; wherein said ratchet drive includes a mounting stud for attachment of a socket thereto; wherein said mounting stud includes a first longitudinal axis; wherein said grip portion includes a second longitudinal axis; wherein said offset crank handle includes a third longitudinal axis; wherein said first, second and third longitudinal axes are parallel to each other; wherein said first longitudinal axis is offset from said second longitudinal axis approximately 0.25 to 0.5 inch; and wherein said second longitudinal axis is located between said first and third longitudinal axes.

* * * * *